US007210972B2

(12) United States Patent
Kitsu et al.

(10) Patent No.: US 7,210,972 B2
(45) Date of Patent: May 1, 2007

(54) OUTBOARD ENGINE

(75) Inventors: Kunihiro Kitsu, Saitama (JP); Shoichi Rinzaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/506,572

(22) Filed: Aug. 18, 2006

(65) Prior Publication Data

US 2007/0042652 A1 Feb. 22, 2007

(30) Foreign Application Priority Data

Aug. 22, 2005 (JP) ..... 2005-240089

(51) Int. Cl.
*B63H 23/00* (2006.01)

(52) U.S. Cl. ..... 440/76; 440/77

(58) Field of Classification Search ..... 440/76, 440/77; 123/195 P

See application file for complete search history.

(56) References Cited

U.S. PATENT DOCUMENTS 5,407,372 A 4/1995 Mondek et al.
5,921,827 A * 7/1999 Ichihashi ..... 440/77

FOREIGN PATENT DOCUMENTS

JP 07-149289 6/1995

* cited by examiner

*Primary Examiner*—Ed Swinehart
(74) *Attorney, Agent, or Firm*—Carrier, Blackman & Associates, P.C.; Joseph P. Carrier; William D. Blackman

(57) ABSTRACT

An outboard engine with a cover for allowing for an improved outward appearance is disclosed. The engine includes a leg case that houses a drive shaft for transmitting the output from the engine to a propeller. The cover covers the leg case. The cover is formed integrally, and a front part is designed to be opened. The front part is opened and is made to encase and cover a periphery of the leg case.

4 Claims, 8 Drawing Sheets

OUTBOARD ENGINE

FIELD OF THE INVENTION

The present invention relates to an outboard engine that is steerably attached to the hull of a boat.

BACKGROUND OF THE INVENTION

Japanese Patent Laid-Open Publication No. 7-149289 (JP-A-7-149289) discloses an outboard engine wherein the outer surface of a drive shaft housing (extension case) in the vertical middle of the outboard engine is covered by a cover.

In this outboard engine, the outer surface of the drive shaft housing is covered with a cover made of a synthetic resin to reduce the finishing costs needed to improve the outward appearance of the drive shaft housing, and also to simplify the design of the drive shaft housing.

The cover that covers the outer surface of the drive shaft housing is configured from a two-piece dividable cover having a port cover and a starboard cover.

Thus, in this outboard engine, covering the outer surface of the drive shaft housing with a cover made of a synthetic resin makes it possible to improve the outward appearance of the drive shaft housing and to simplify the external structure of the housing, and also allows for a greater degree of freedom in the design.

However, since this cover is configured from two members, which are the port cover and the starboard cover, a large number of attachment bosses is needed to attach and support these two members on the outer surface of the drive shaft housing, the attachment structure of the cover and the drive shaft housing is complicated, and the number of steps for attachment is increased. Particularly, since the cover is configured from two members, pressure must be applied to both the left and right components when the left and right components are assembled, making operability inferior.

In view of this, the outward appearance of the cover must be simplified, as must the structure for attaching the cover to the drive shaft housing.

SUMMARY OF THE INVENTION

According to the present invention, there is provided an outboard engine designed to be steerably attached to a hull of a boat by an attachment device, which outboard engine comprises an engine part, a propeller driven by the engine part, a transmission device that includes a longitudinal shaft and a propeller shaft for transmitting an output of the engine part, and a main body for housing at least the engine part and the transmission device, wherein the main body is composed of a leg case that extends in a longitudinal direction and that houses at least part of the longitudinal shaft of the transmission device, and a cover that covers an outer side of the leg case; and the cover is formed integrally by forming a starboard outer surface and a port outer surface continuously in a rear portion of the outboard engine, and is provided with an anti-splash plate formed integrally on a front surface.

Thus, in the outboard engine, since the cover is formed integrally by forming a starboard outer surface and a port outer surface continuously at the rear of the outboard engine, there are no dividing lines or joining lines in the rear surface of the cover of the outboard engine, for which a favorable outward appearance is vital, and the outward appearance is significantly improved in the outboard engine in which the outer surface of the leg case is covered with a cover.

Furthermore, since the cover is configured from a single member, the number of components is reduced, and there are fewer attachment portions on the cover, and fewer attachment parts on the leg case. Furthermore, since a single member is set on the side of the leg case, there is no need for multiple setting devices or positioning means, which are needed to set a cover composed of two members, and the operation of the attachment can be simplified.

Furthermore, the number of components can be reduced since the starboard outer surface and the port outer surface constituting the cover are formed integrally and the anti-splash plate is provided integrally to the front surface.

It is preferable that the cover have a frontally disposed interlocking part that interlocks with the leg case. Therefore, positioning alignment is simplified during assembly with the leg case side of the outboard engine.

It is preferable that the cover have fastening parts, and that the fastening parts be provided so as to be in contact with the anti-splash plate and the cover. Therefore, providing the fastening parts that span both the anti-splash plate and the cover is effective for reinforcing the periphery of the fastening parts, and makes it possible to ensure sufficient rigidity when the anti-splash plate is subjected to external forces.

It is preferable that the cover be provided separately from the attachment device. The anti-splash plate is not limited to the height of the attachment device, and the height of the anti-splash plate can be designed at an arbitrary position. Furthermore, the height of the anti-splash plate is close to the water surface as long as the height is set lower than the height of the attachment device, and the required width of the anti-splash plate can therefore be prevented from being needlessly increased.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
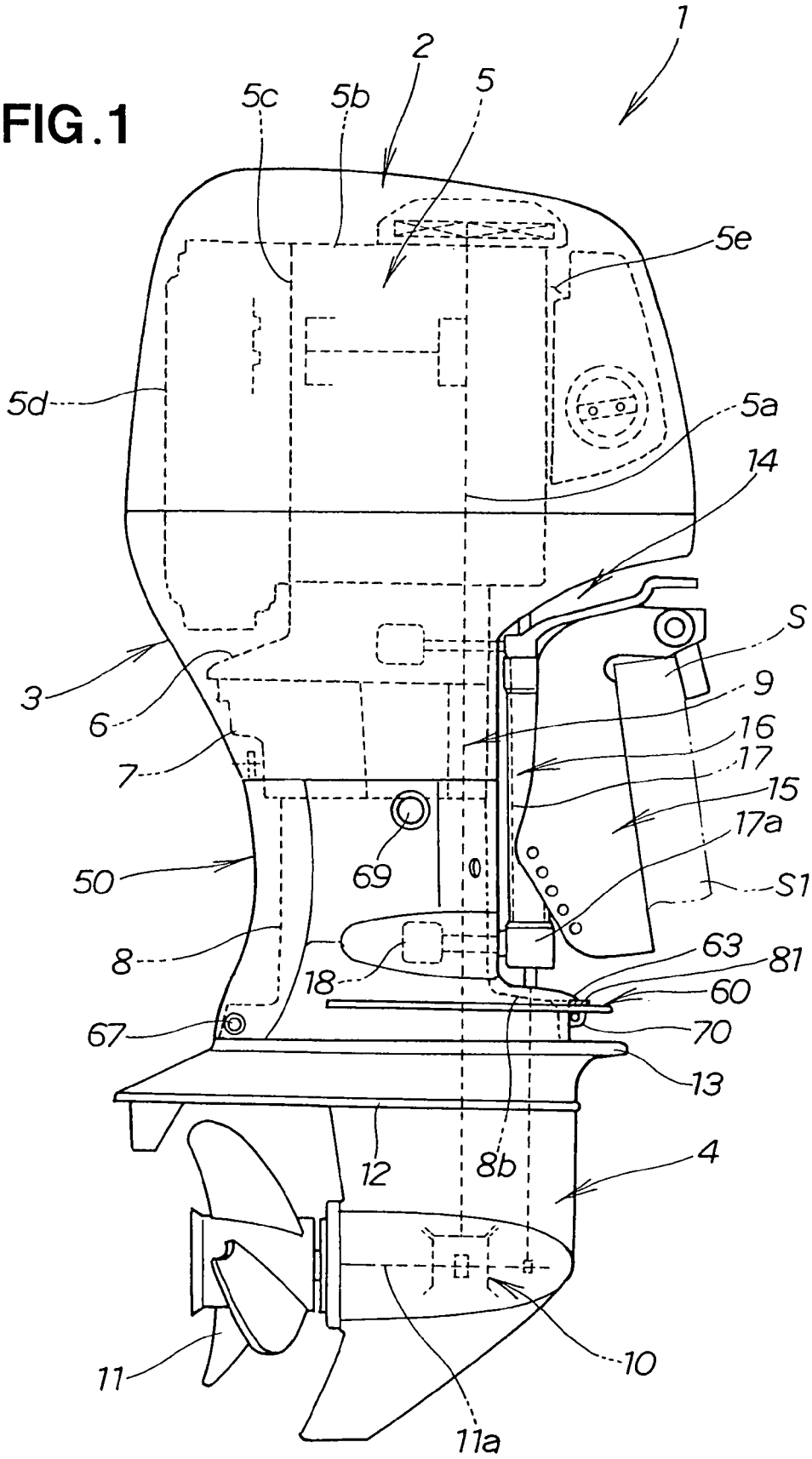
FIG. 1 is a side view of the outboard engine of the present invention on which a leg cover is mounted.

Referring to FIG. 1, an outboard engine 1 comprises an engine cover 2 that houses an engine part 5; an undercover 3 that is positioned below the engine cover 2; a leg cover 50 that is positioned below the undercover 3 and that covers a leg case (extension case) 8, which is a drive shaft housing; and a gear case 4 at the lowest position.

The engine part 5 is composed of a multi-cylinder four-stroke engine having a longitudinally oriented crankshaft 5*a*, a transversely oriented cylinder block 5*b*, a cylinder head 5*c*, a cylinder head cover 5*d*, a crankcase 5*e*, and a camshaft (not shown).

The engine cover 2 covers the top half of the engine part 5, and the top of the undercover 3 covers the bottom of the engine part 5. The bottom end of the engine part 5 is supported by a mounting case 6. An oil case 7 is disposed below the mounting case 6. The oil case 7 and the gear case 4 are connected by the leg case 8.

A drive shaft 9 is connected to the crankshaft 5*a*, and passes vertically through the mounting case 6, the oil case 7, and the leg case 8 and extends into the gear case 4. The drive shaft 9 transmits the drive force outputted from the engine part 5 to a propeller shaft 11*a* via a gear mechanism 10 installed in the gear case 4, thereby driving a propeller 11. The drive shaft 9 and the propeller 11 constitute a transmission device.

An anti-cavitation plate 12 is provided on the gear case 4 at a position above the propeller 11. An anti-splash plate 13 is provided on the gear case 4 at a position above the anti-cavitation plate 12.

A concavity 14 in which a stern bracket 15 and a swivel case 16 are installed is formed in the front of the undercover 3 and the leg cover 50. The outboard engine 1 is attached to the stern S1 of a hull S by means of the stern bracket 15. This stern bracket 15 is an attachment device for attaching the outboard engine 1 to the stern S1. The outboard engine 1 swings vertically about a tilt shaft 15*a* provided to the stern bracket 15, and also swings horizontally about a swivel shaft 17 inside the swivel case 16. The swivel shaft 17 enables the outboard engine 1 to be steered.

The outboard engine main body is configured from the engine part, the mounting case, the oil case, the leg case, and the engine cover and undercover that house these components.

Next, the configuration of the leg cover 50 will be described with reference to FIGS. 2 through 7.

Compared to the portion of the leg cover 50 that extends from a top part 50*a* to a middle part 50*b*, a bottom half 50*c* is longer in the longitudinal direction of the outboard engine 1, i.e., is formed to protrude farther forward. Thus, the leg cover 50 is in the shape of a long boot and comprises a port side wall 51, a starboard side wall 52, and a rear side wall 53 in which the rear ends of the port side wall 51 and the starboard side wall 52 are formed integrally.

The front ends of the port side wall (port outer surface) 51 and the starboard side wall (starboard outer surface) 52 that extend from the top parts to the middle parts have left and right front side walls 55, 56 that are bent inward so as to face each other. The left and right front side walls 55, 56 are connected in a joining part 54, and protrude so as to form a V shape in plan view. Left and right protruding parts 51*a*, 52*a* that protrude outward are formed in portions that extend from the bottoms of the left and right front side walls 55, 56 to the front halves of the port and starboard side walls 51, 52.

A protruding frame 58 that protrudes farther forward than the left and right front side walls 55, 56 is formed on the protruding parts 51*a*, 52*a*. The protruding frame 58 is composed of left and right portions 58*a*, 58*b* that are both in the shape of a U when viewed from the front, wherein a window 57 having a horizontal rectangular shape is formed in the front surface. The left and right portions 58*a*, 58*b* face each other. The top surface 58*c* of the protruding frame 58 forms a shelf and protrudes laterally forward.

The port and starboard side walls 51, 52 have extending parts 51*b*, 52*b* that extend forward in the bottom. The extending parts 51*b*, 52*b* have roof parts 51*c*, 52*c* in the top surfaces.

Figure 4:
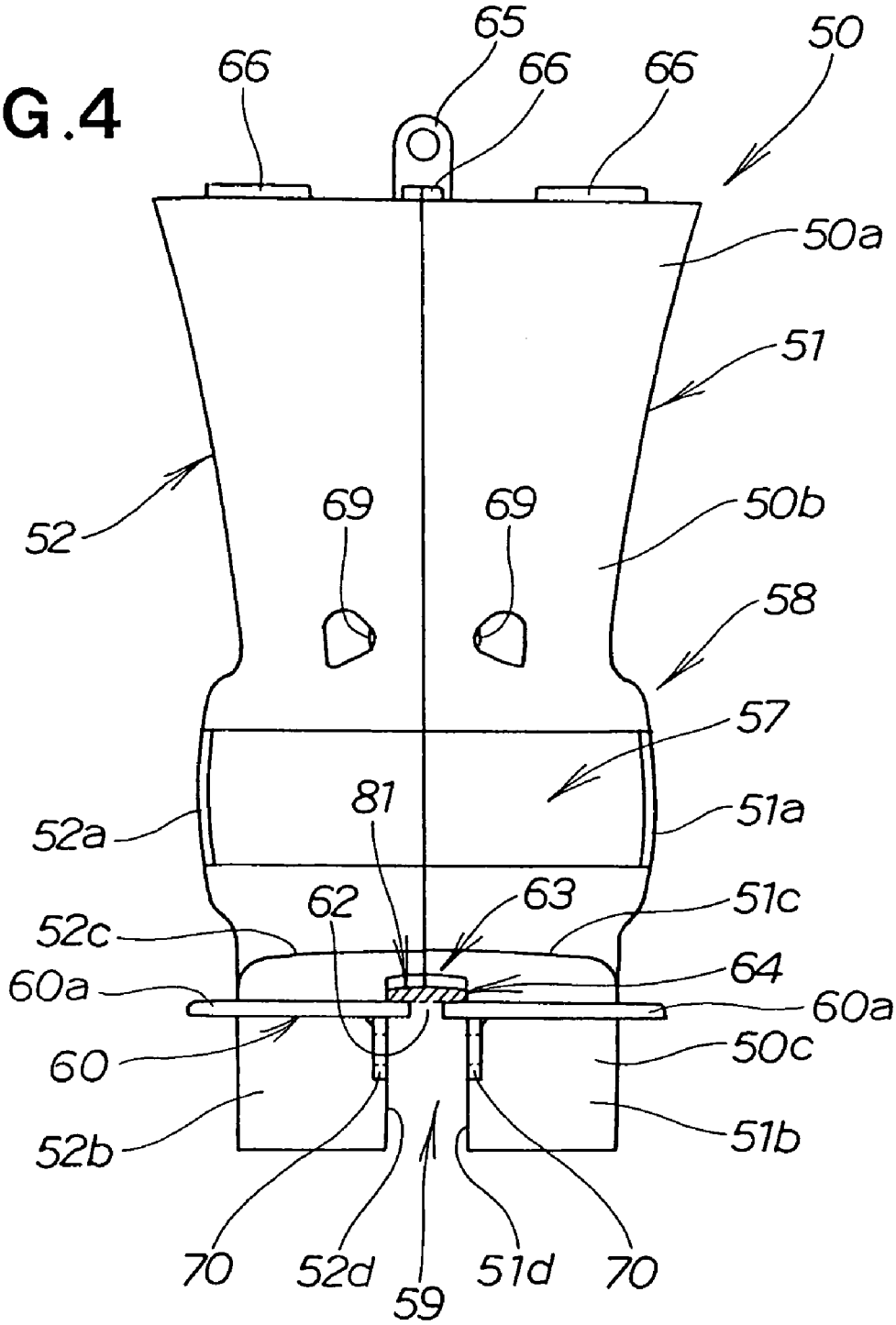
FIG. 4 is a front view of the leg cover shown in FIG. 2.
Figure 5:
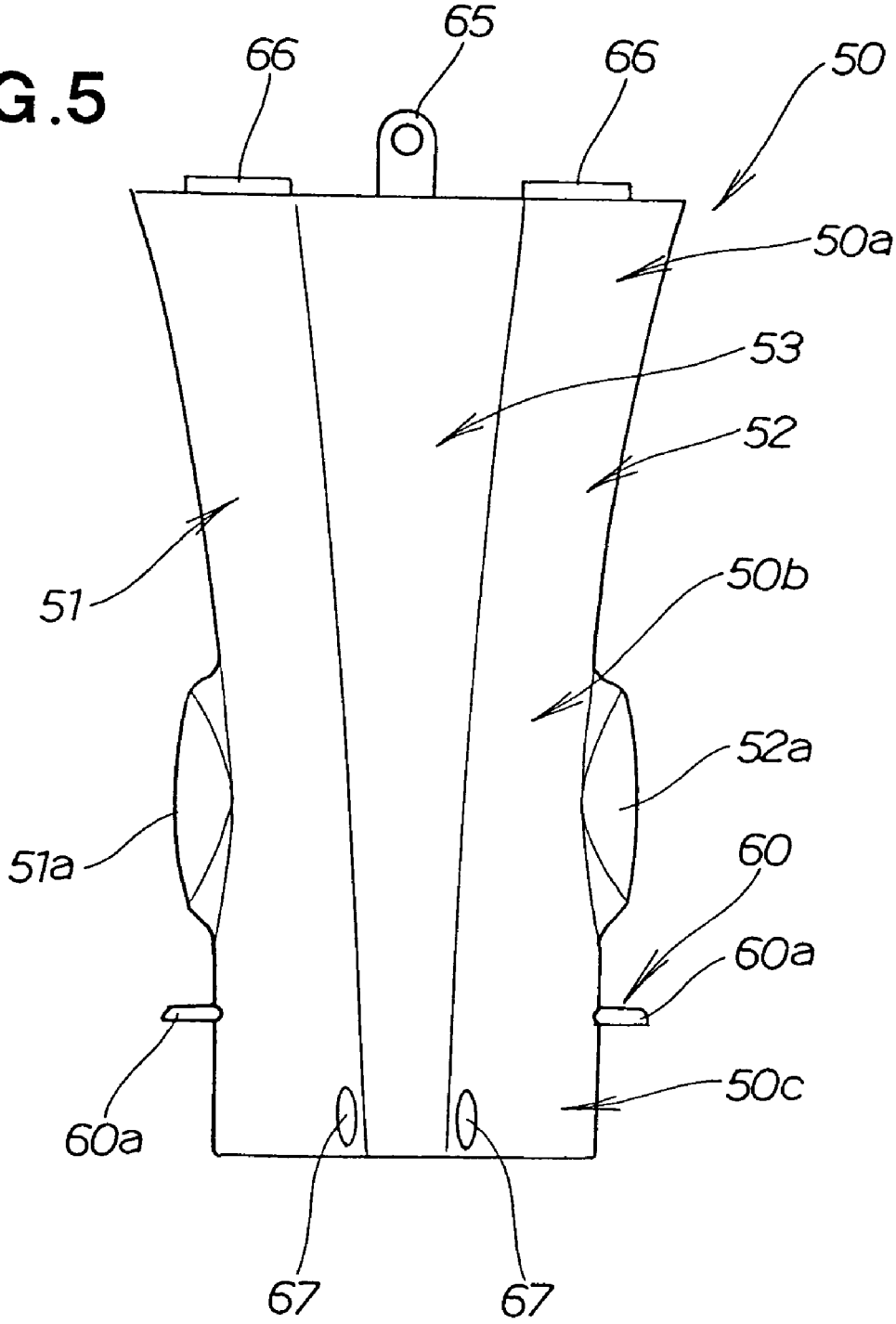
FIG. 5 is a rear view of the leg cover shown in FIG. 2.

A gap 59 is formed between the end edges 51*d*, 52*d* of the portions that protrude from the left and right extending parts 51*b*, 52*b*, as shown in FIG. 4. Anti-splash plate halves 60*a*, 60*a* that form a substantial half circle when joined together are formed integrally in the tops of the left and right extending parts 51*b*, 52*b*. The anti-splash plate halves 60*a*, 60*a* extend forward from the left and right extending parts 51*b*, 52*b*, and the distal ends thereof have arcuate shapes. An anti-splash plate 60 is configured form the anti-splash plate halves 60*a*, 60*a*.

Notches 61, 61 are formed in the front ends of the anti-splash plate 60. A narrow gap 62 that extends in the longitudinal direction is formed behind these notches 61, 61. A space is formed in the area behind the gap 62. A roof piece 63 that protrudes from the front ends of the left and right roof parts 51*c*, 52*c* is formed at a position above this space. An interlocking part 64 is formed by the roof piece 63 and the gap 62.

The leg cover 50 has an attachment piece 65 provided in the top edge at the rear so as to protrude upward, and multiple interlocking pieces 66 provided in the top edge at the front so as to protrude upward. Fastening holes 67, 67 are formed in the bottom rear parts of the port and starboard side walls 51, 52. Fastening holes 68, 68 are also formed in the front side walls 55, 56. The reference number 69 in FIG. 2 denotes a drain hole.

Figure 7:
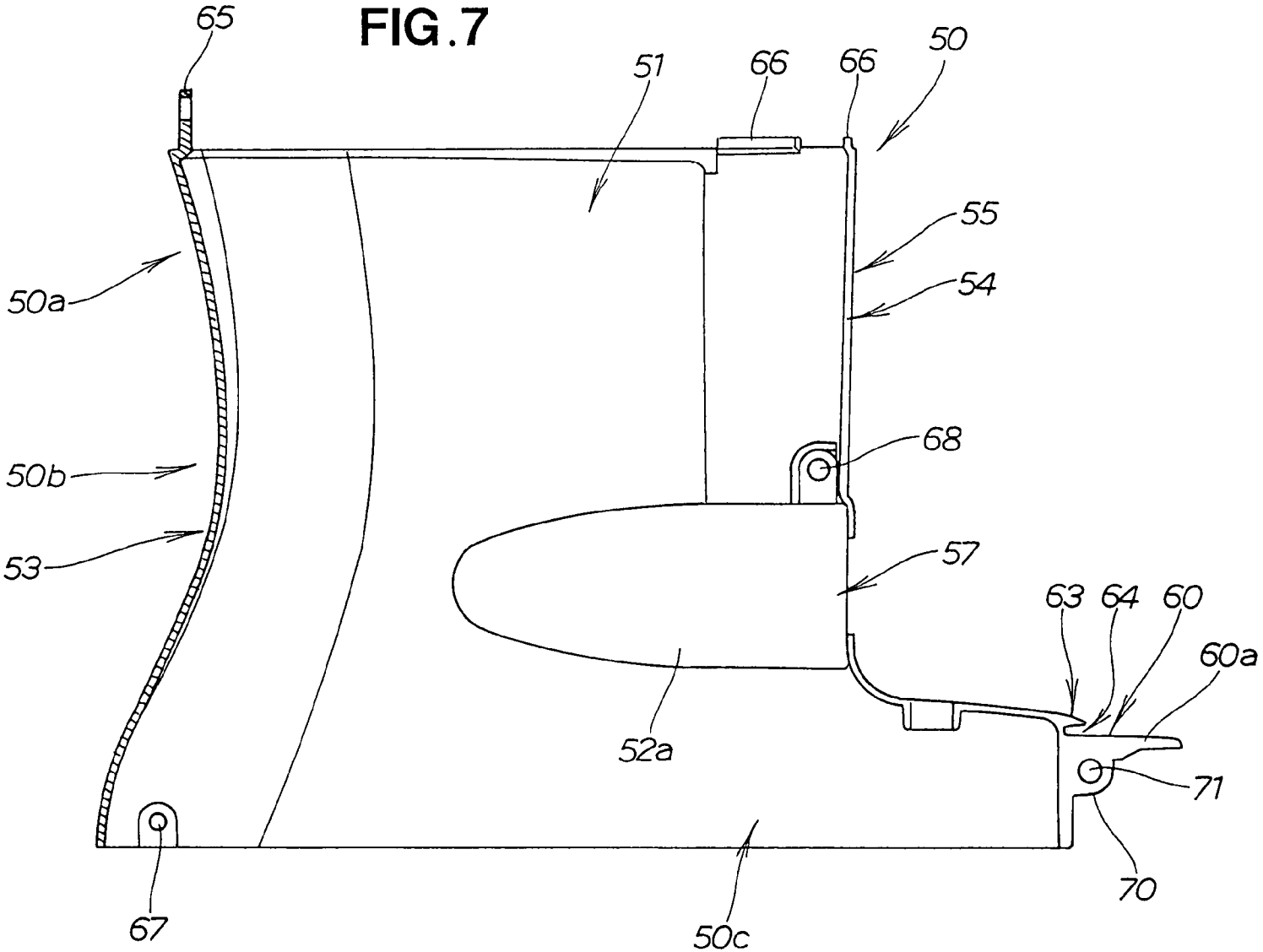
FIG. 7 is a longitudinal cross-sectional view of the leg cover shown in FIG. 2.

A gap 62 is formed between the left and right portions 60*a*, 60*a* of the anti-splash plate 60, as shown in FIG. 4. Reinforcing ribs 70, 70 are provided at the top halves of the opposing end edges 51*d*, 52*d* of the port and starboard side walls 51, 52. These reinforcing ribs 70 are connected to the extending parts 51*b*, 52*b* and to the anti-splash plate 60, and constitute a fastening unit for fastening the port and starboard side walls 51, 52. The reinforcing ribs 70 fasten the port and starboard side walls 51, 52 together when a bolt is inserted through fastening holes 71, as shown in FIG. 7.

The leg cover 50 is integrally molded from a synthetic resin.

Figure 8:
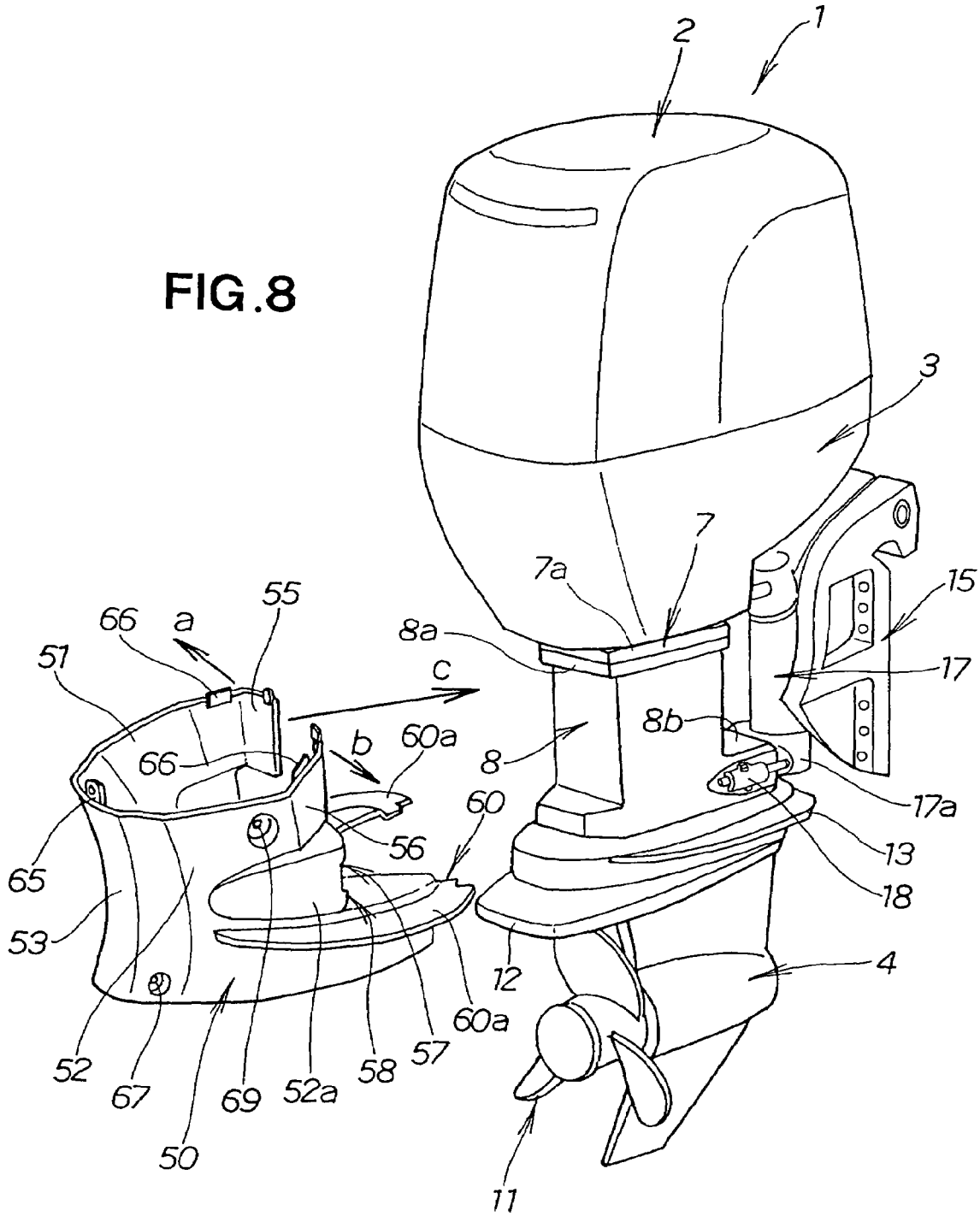
FIG. 8 is an exploded perspective view of the leg cover being assembled on the leg case.

The leg case 8 has at the top end a flange 8*a* that bonds with a bottom end flange 7*a* of the oil case 7, as shown in FIG. 8. A protrusion 8*b* that protrudes forward is formed in the bottom front surface of the leg case 8. Both sides of the protrusion 8*b* are provided with mounting housings 8, 18 that buffer and support a center housing 17*a* provided at the bottom end of the swivel shaft 17.

Figure 2:
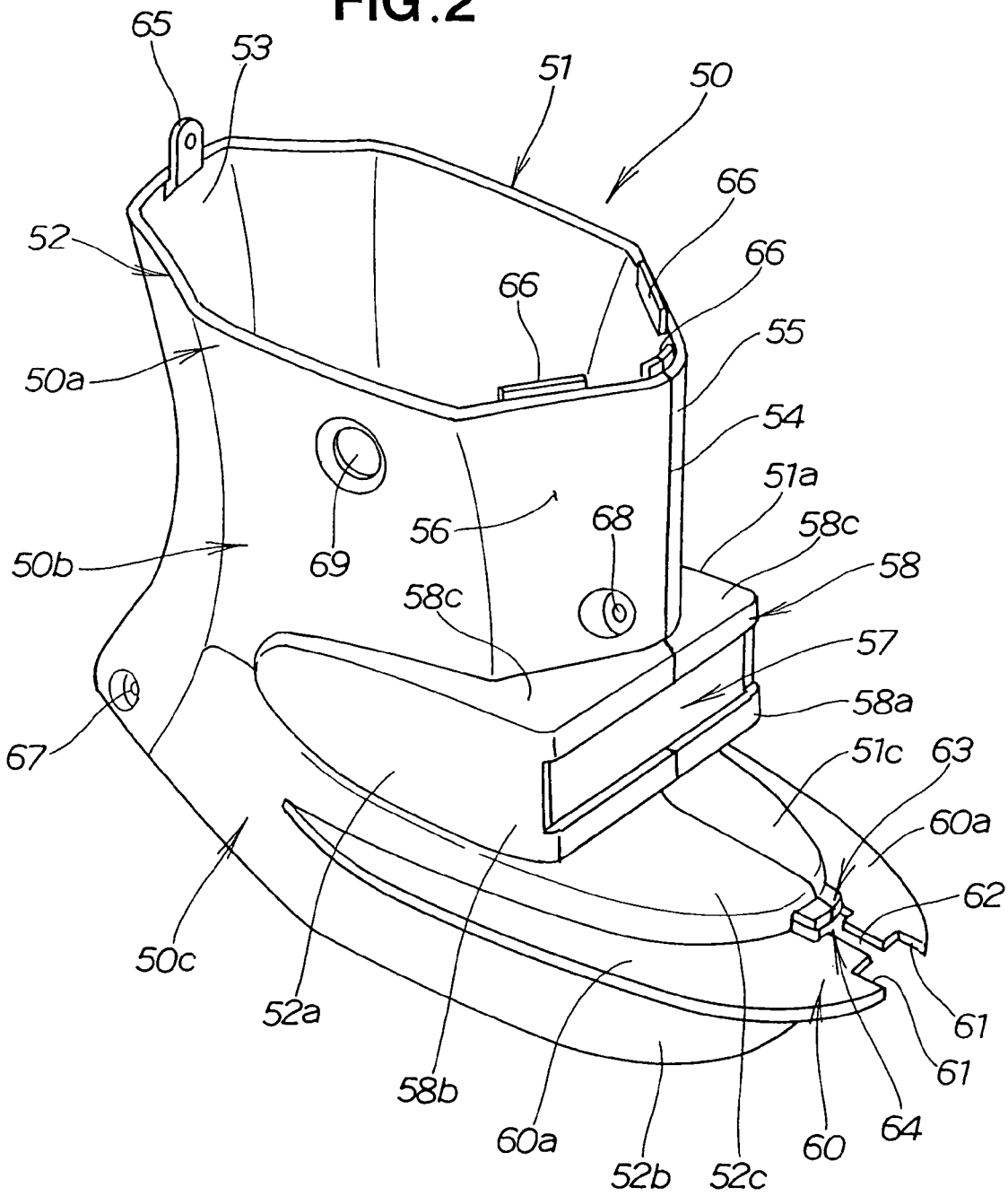
FIG. 2 is a perspective view of the leg cover shown in FIG. 1 as viewed from above on the starboard side.
Figure 3:
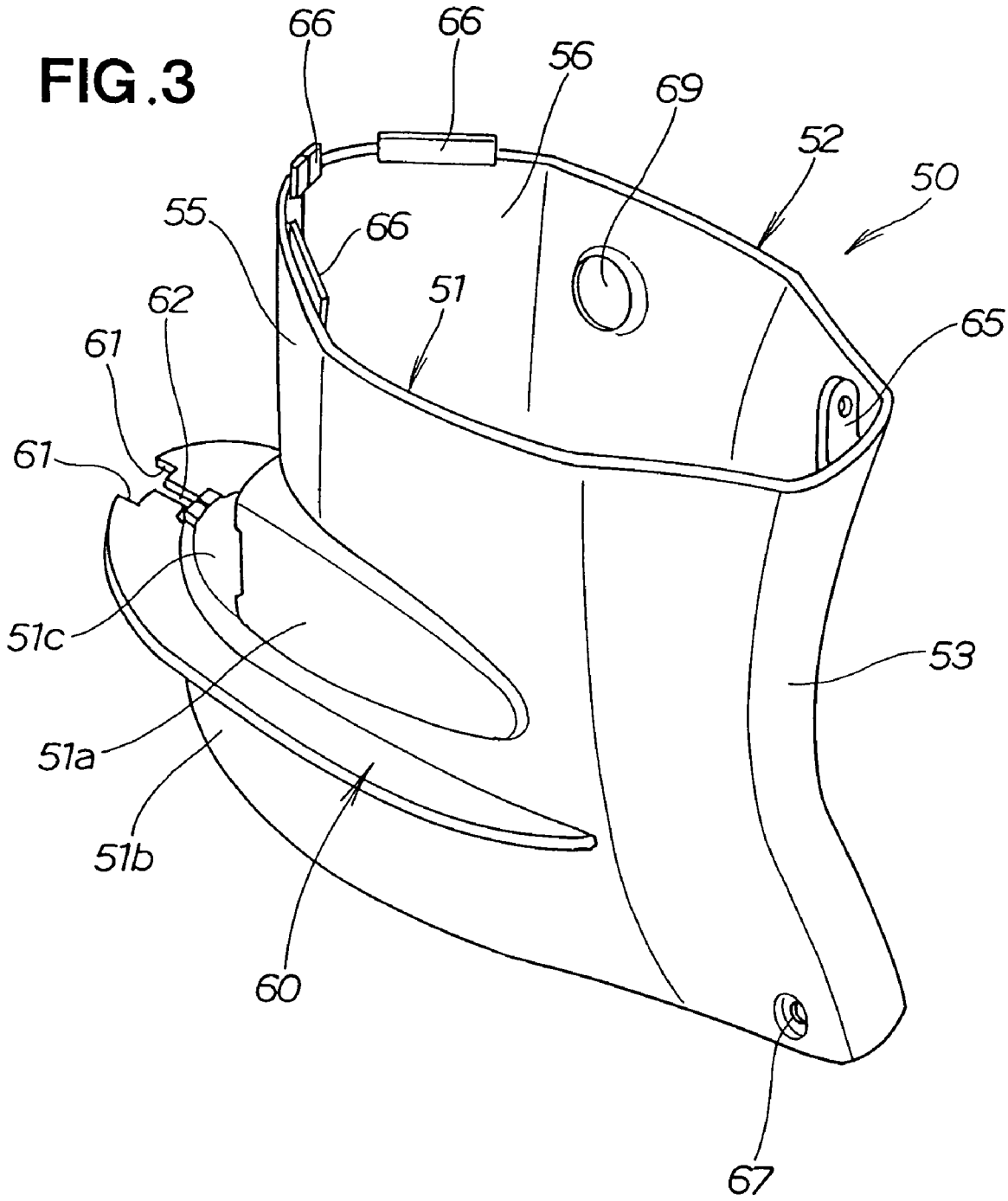
FIG. 3 is a perspective view of the leg cover shown in FIG. 1 as viewed from above on the port side.

Next, the procedure of assembling the leg cover 50 on the leg case 8 will be described with reference to FIGS. 2 and 8.

First, the port and starboard side walls 51, 52 of the leg cover 50 are separated to the left and right as shown by the arrows a and b, and a space is opened between the left and right front side walls 55, 56 that are opened to the left and right. In this state, the leg cover 50 is oriented forward and is fitted over the rear of the leg case 8 of the outboard engine 1, as shown by the arrow c.

At this time, the bottom end of the leg cover 50 is moved along the top surface of the anti-splash plate 13 provided at the bottom of the outboard engine 1 to move the leg cover 50 forward and to encase the leg case 8 from the sides. The leg cover 50 is made of a flexible synthetic resin, and the rear side wall 53 of the port and starboard side walls 51, 52 easily bends and expands.

When the leg cover 50 is moved forward in the direction of the arrow c, the left and right protruding parts 51*a*, 52*a* enclose the mounting housings 18, 18 from the sides, thereby hiding the mounting housings 18, 18. The protrusion 8*b* is encircled by the protruding frame 58, and the front end surface of the protrusion 8*b* faces the window 57.

Figure 6:
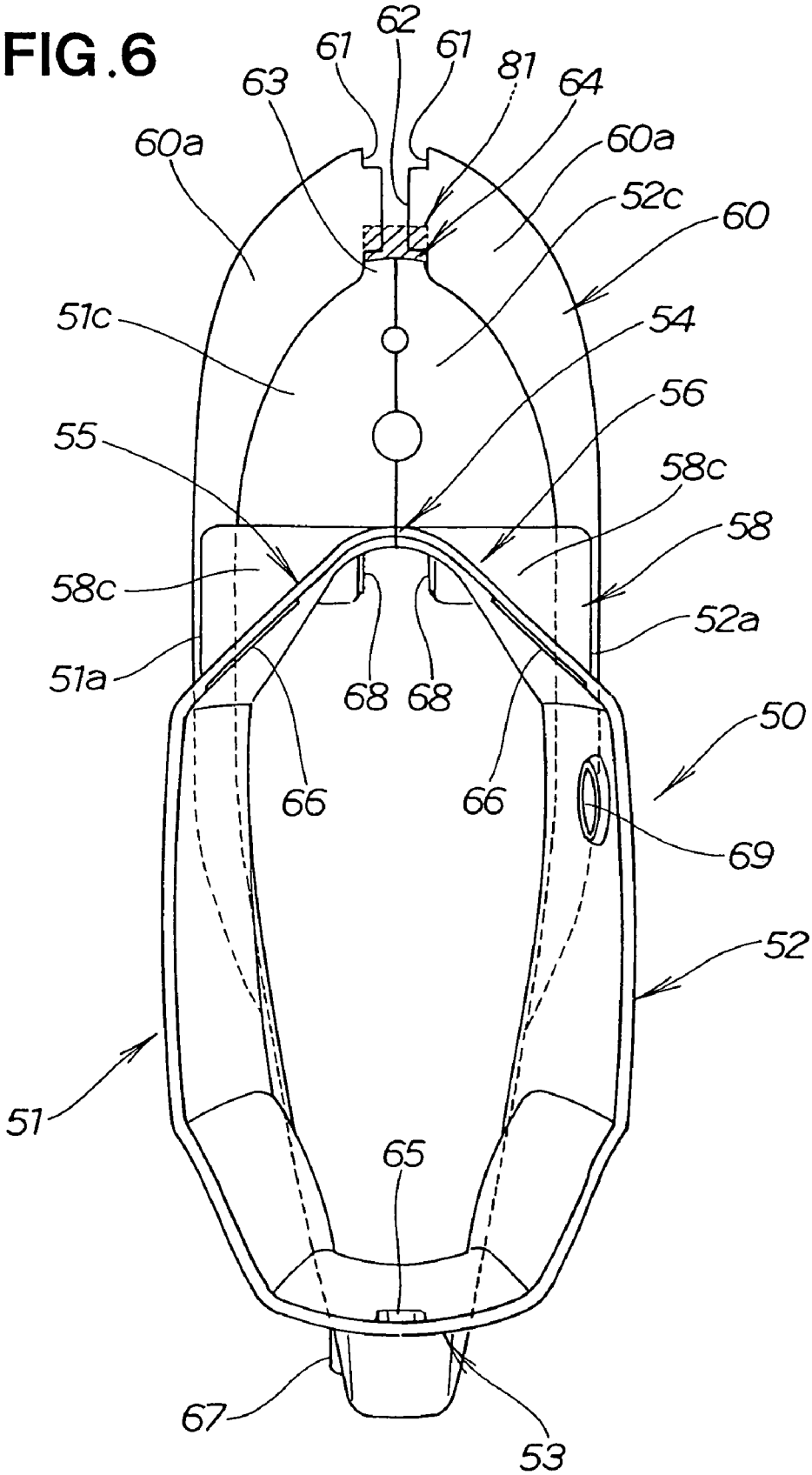
FIG. 6 is a plan view of the leg cover shown in FIG. 2.

A tongue-like interlocking piece 81 shown in FIGS. 1, 4, and 6 is provided at the bottom front end of the leg case 8. The interlocking piece 81 protrudes forward from the interlocking part 64 between the roof piece 63 and the front top surface of the anti-splash plate 60 shown in FIG. 2, and allows the leg case 8 and the leg cover 50 to be easily positioned during assembly.

The attachment piece 65 at the rear of the leg cover 50 is screwed onto the undercover 3, and the interlocking pieces 66 at the front are interlocked with the undercover 3. The leg cover 50 is bolted onto the leg case 8 by using the fastening holes (fastening parts) 67, 67 shown in FIG. 2. The left and right front side walls 55, 56 of the leg cover 50 are connected using bolts via the fastening holes (fastening parts) 68, 68. The anti-splash plate 60 is fastened by inserting a bolt through the fastening holes 71, 71 in the reinforcing ribs (fastening parts) 70, 70. Thus, the leg cover 50 is attached so as to cover the outer surface of the leg case 8.

The leg cover 50, rather than being a two-piece dividable member, is formed from a single integrated plate member, wherein the front portion is opened to encase and cover the leg case 8 of the outboard engine 1, and then the cover is easily attached to the leg case 8 by being fastened using bolts.

Obviously, various minor changes and modifications of the present invention are possible in light of the above teaching. It is therefore to be understood that within the scope of the appended claims the invention may be practiced otherwise than as specifically described.

What is claimed is:

1. An outboard engine designed to be steerably attached to a hull of a boat by an attachment device, comprising:

an engine part;

a propeller driven by the engine part;

a transmission device that includes a longitudinal shaft and a propeller shaft for transmitting an output of the engine part; and a main body for housing at least the engine part and the transmission device; wherein the main body is composed of a leg case that extends in a longitudinal direction and that houses at least part of the longitudinal shaft of the transmission device, and a cover that covers an outer side of the leg case; and the cover is formed integrally by forming a starboard outer surface and a port outer surface continuously in a rear portion of the outboard engine, and is provided with an anti-splash plate formed integrally on a front surface.

2. The outboard engine of claim 1, wherein the cover has a frontally disposed interlocking part that interlocks with the leg case.

3. The outboard engine of claim 1, wherein the cover has fastening parts, and the fastening parts are provided so as to be in contact with the anti-splash plate and the cover.

4. The outboard engine of claim 1, wherein the cover is provided separately from the attachment device.

* * * * *